US005377872A

United States Patent [19]

Mauney

[11] Patent Number: 5,377,872

[45] Date of Patent: Jan. 3, 1995

[54] INDICATOR VALVE FOR A FIRE EXTINGUISHER

[75] Inventor: Ronald C. Mauney, Snow Camp, N.C.

[73] Assignee: Walter Kidde Portable Equipment, Inc., Mebane, N.C.

[21] Appl. No.: 149,466

[22] Filed: Nov. 9, 1993

[51] Int. Cl.[6] ..... B67D 5/22

[52] U.S. Cl. ..... 222/47; 222/153; 222/518; 137/197; 137/614.11; 137/614.19; 169/75; 169/76

[58] Field of Search ..... 222/47, 153, 518, 394, 222/559; 137/197, 614.11, 614.19, 557; 169/75, 76, 30, 71, 74, 89

[56] References Cited

U.S. PATENT DOCUMENTS 1,831,193 11/1931 Quitschalle .
2,570,655 10/1951 Druge .
2,931,376 4/1960 Hendel ..... 137/197
3,229,851 1/1966 Horwitt et al. .
3,536,095 10/1970 Demeter et al. .
3,861,474 1/1975 DePalma ..... 169/75
4,119,153 10/1978 Avant .
4,619,328 10/1986 Seyler et al. .
4,822,003 4/1989 Self .
4,862,968 9/1989 Woodman .

*Primary Examiner*—Gregory L. Huson
*Attorney, Agent, or Firm*—Darby & Darby

[57] ABSTRACT

A valve, particularly useful in a fire extinguisher, includes a valve housing having a through bore. A valve stem is disposed within the bore and is axially moveable between a first position, a second position, and a third position. The valve stem includes a seal adjacent to the second axial end for sealing with the first section of the bore. A cap is disposed within the second section of the bore and is axially moveable between a first position and a second position. The cap includes a seal for sealing with the bore when the cap is in the first position. The cap seal is impermeable to solids and permeable to gas when the cap is in the first position.

22 Claims, 3 Drawing Sheets

FIG. 1
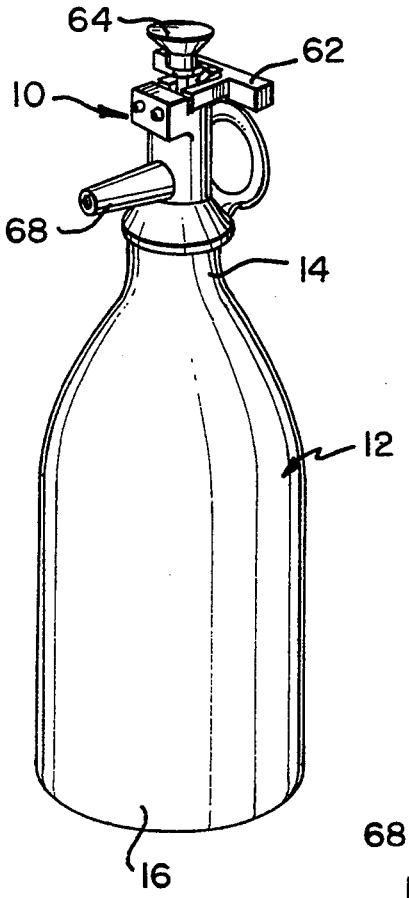
FIG. 7
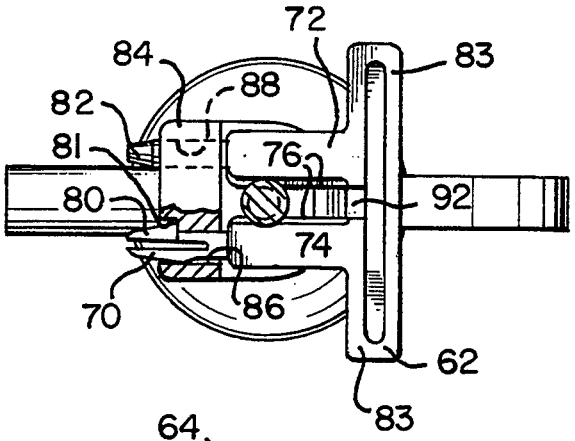
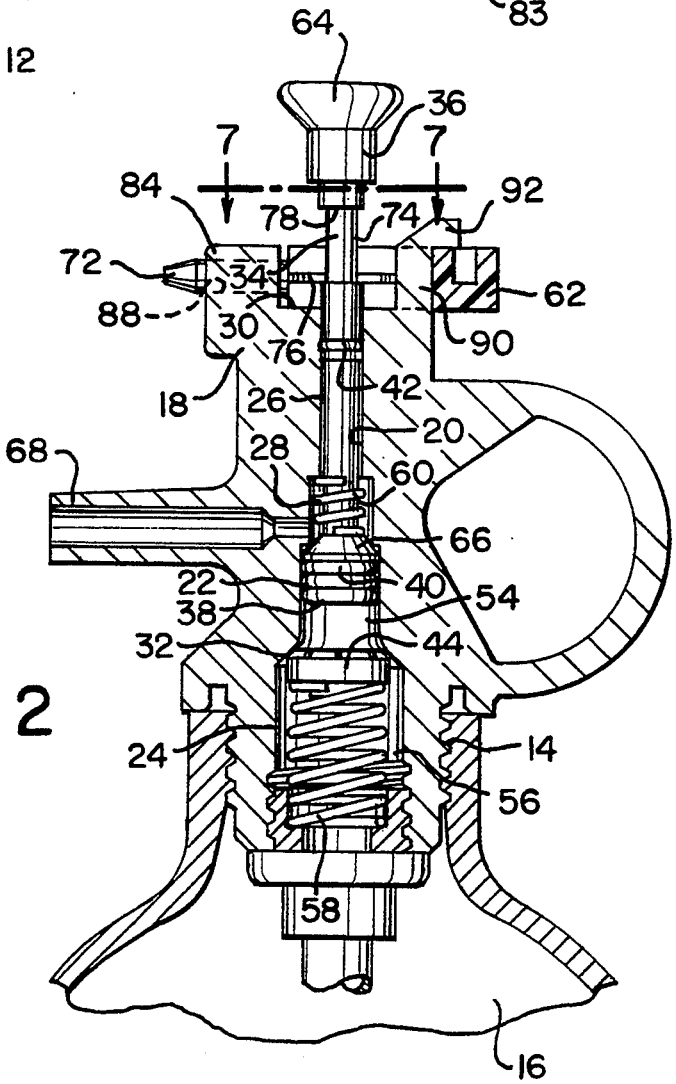
FIG. 2

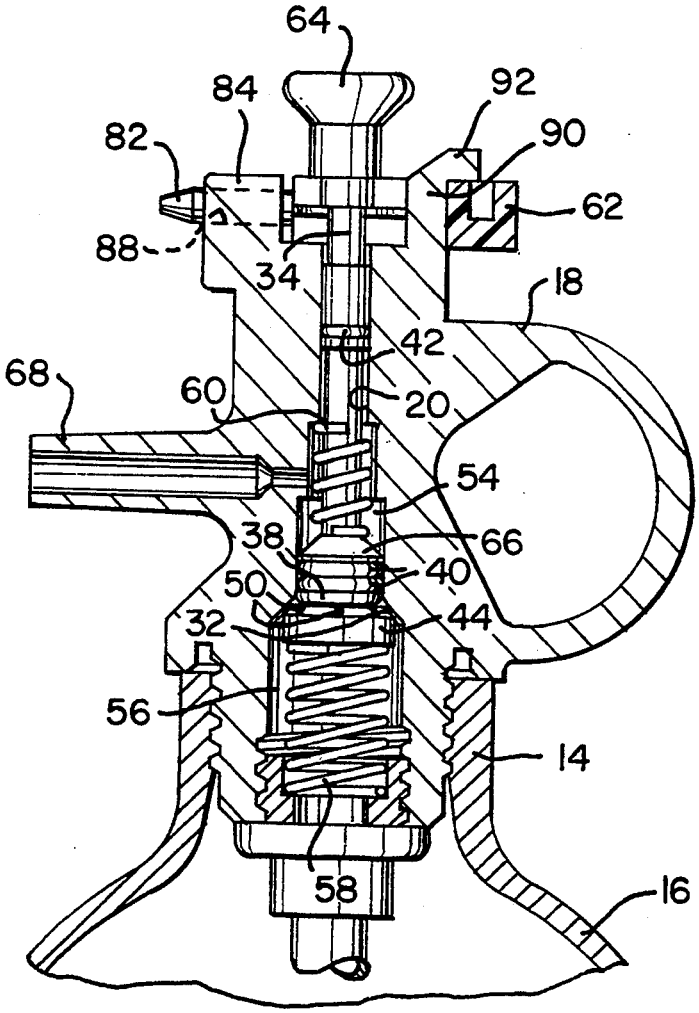
FIG. 3
FIG. 4
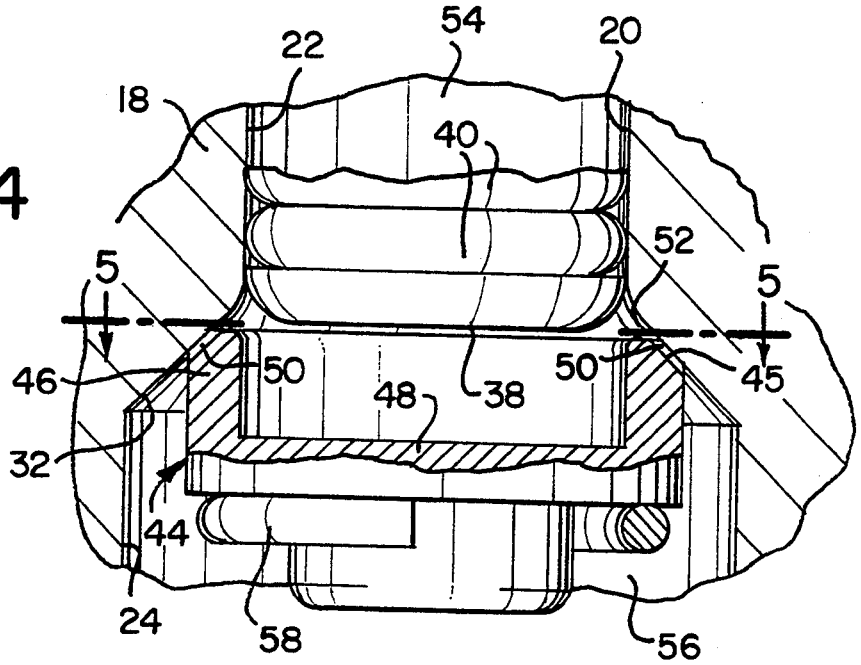

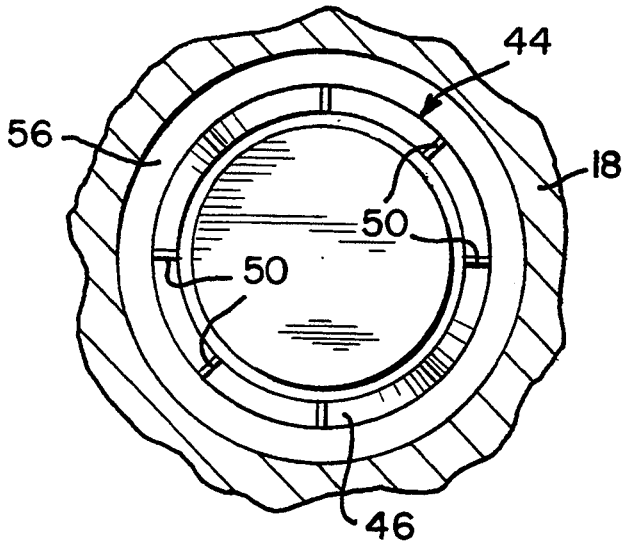
FIG. 5
FIG. 6
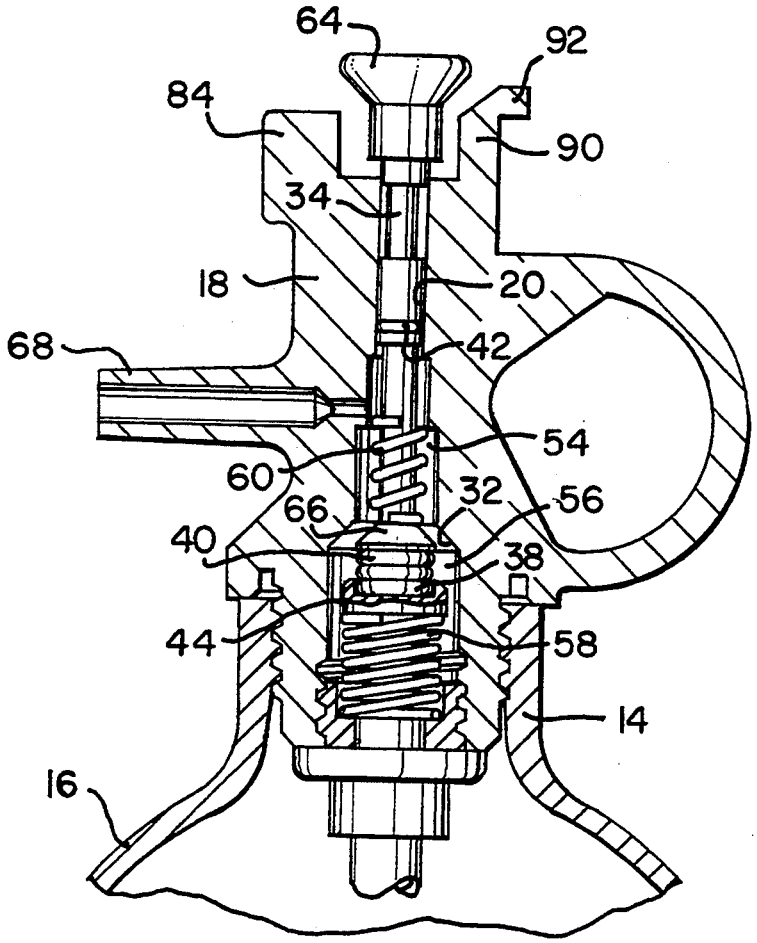

INDICATOR VALVE FOR A FIRE EXTINGUISHER

FIELD OF THE INVENTION

The present invention relates generally to valves. More specifically, the present invention relates to fire extinguishers having a valve that includes a pressure indicator and a dust cap to prevent dry chemical powder from fouling the valve.

BACKGROUND OF THE INVENTION

Dry chemical fire extinguishers are usually employed to extinguish fires by depressing a lever or a valve stem head on the exterior of the fire extinguisher. This action, in turn, opens a valve in the interior of the fire extinguisher to release pressurized dry chemical material. Fire extinguishers are also equipped with an indicator which can be used to determine if there is sufficient gas pressure within the container to expel the contents. Some types of indicators form a part of and allow limited movement of the valve to visually show whether or not the container is sufficiently charged without opening the valve. An example of such a fire extinguisher is disclosed in U.S. Pat. No. 3,229,851 to Horwitt et al. ("Horwitt").

Notwithstanding the foregoing valve and pressure indicator arrangements, there are still major problems involved with such prior an valves. The dry chemical agents, such as sodium bicarbonate, often leave a residual powder in the vicinity of the valve seat. Consequently, the valve may no longer properly seal of the valve seat leading to a slow, but steady, loss of pressure from within the container. Additionally, the valve stem may no longer be free to move axially, reducing the accuracy of the indicator. In the valve disclosed by Horwitt, dry chemical powder is free to communicate with an O-ring seal 26. The powder thus forms a residue about the O-ring 26 and the sealing section 21 of sleeve 19. Eventually this residue will foul up the axial movement of the valve stem.

This residue build up could lead to a false negative test from the pressure indicator if the valve stem 24 were stuck in the depressed position shown in FIG. 4. Worse yet, a false positive test may result if the residue prevents the valve stem from being depressed from the position shown in FIG. 2, leading the user to conclude that a sufficient amount of pressure is contained within the fire extinguisher when, in fact, there may be no such pressure.

It is, therefore, an object of the present invention to provide an indicator valve that permits repeated testing of the pressurized container to ensure that it has sufficient pressure, while simultaneously preventing the dry chemical powder from fouling the axial movement of the valve stem.

It is an object of the present invention to provide a so-called pindicator-type valve that requires less pans and, thus, is smaller and easier to manufacture. It is still a further object of the present invention that the pindicator-type valve arrangement be simple and cost effective to manufacture, yet reliable and efficient in use.

SUMMARY OF THE INVENTION

The pindicator-type valve arrangement of the present invention includes a valve housing mounted on the outlet of a container. A through bore extends through the housing and has a first section and a second section of different diameters and a transition section therebetween. A valve stem has a first axial end and a second axial end and is disposed within the bore. The valve stem is axially moveable between a first position, a second position and a third position. The valve stem includes a seal adjacent to the second axial end for sealing with the first section of the bore. A cap is disposed within the second section of the bore and is axially moveable between a first position and a second position. The cap includes a seal for sealing with the bore when the cap is in the first position. The cap seal is impermeable to solids and is permeable to gas when the cap is in the first position.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 1 is a perspective view of a pindicator valve secured to the outlet of a pressurized container according to the present invention;

FIG. 2 is a sectional view of the pindicator valve in a first axial position;

FIG. 3 is a sectional view of the pindicator valve in a second axial position;

FIG. 4 is an enlarged sectional view of the pindicator valve in the second position shown in FIG. 3;

FIG. 5 is a sectional view taken along lines 5—5 of FIG. 4 and looking in the direction of the arrows;

FIG. 6 is a sectional view of the pindicator valve in a third axial position; and FIG. 7 is a sectional view, with parts broken away, taken along line 7—7 of FIG. 2.

DETAILED DESCRIPTION OF THE PRESENT PREFERRED EXEMPLARY EMBODIMENTS

Referring to FIG. 1, a pindicator valve 10 and a container 12 are illustrated. Referring to FIG. 2, the pindicator valve 10 includes a valve housing 18 that is threadably connected to an outlet 14 of the container 12. Alternatively, the valve housing 18 could be mounted on the housing 16 of the container by a number of different methods, such as a snap fit, a press-fit, etc. The valve housing 18 includes a through bore 20. As illustrated, the through bore 20 includes five sections of different diameters. The sections include a first section 22, a second section 24, a third section 26, a fourth section 28 and a fifth section 30, all of different diameters. The transition segment 32 between the first section 22 and the second section 24 of the through bore 20 is illustrated as a bevelled or tapered surface 32. The remaining transition sections (unnumbered) are shown as a stepped surface. A valve stem 34 is slidably mounted within the through bore 20. The valve stem 34 has a first axial end 36 and a second axial end 38. The valve stein includes a seal in the form of a pair of O-rings 40 adjacent to the second axial end 38 for sealing with the first section 22 of the bore 20. The valve stem also includes a second seal in the form of an O-ring 42 adjacent to the first axial end 36 for sealing with the third section 26 of the through bore 20.

A dust cap 44 is disposed in the second section 24 of the bore 20. As illustrated in FIGS. 2, 3 and 4, the cap 44 is in contact with the transition segment 32 of the bore 20. The cap 44 has an annular ring-shaped section 46 which terminates in an upper surface, the outer edge 45 of which is formed complimentary to the taper of the wall or transition segment 32 (FIG. 4), and a disc-shaped section 48. The edge 45 has a plurality of circumferentially spaced outwardly projecting raised ridges 50 (see FIG. 5). Thus, the raised ridges 50 of the cap 44 actually contact the transition segment 32 thereby spacing the edge 45 therefrom. Thus, a gap 52 is provided between the ring-shaped section 46 of the cap 44 and the transition segment 32 (see FIG. 4). The height of the gap 52 is substantially equal to the height of the raised ridges 50. The height of the raised ridges 50, and thus the gap 52, is sized to allow gaseous fluid communication between chamber 54, above cap 44, and chamber 56, below cap 44; it being understood that relative orientation adjectives such as "above", "below", etc., are utilized herein to simplify the present description and are not intended to limit the orientation of the pindicator valve assembly when mounted for use. The gap 52 is also sized so as to prevent the flow of solids, such as a dry chemical powder, between chambers 56 and 54. For example, the gap can be approximately 0.003" and the taper can be 45°.

A first spring 58 is disposed within the second section 24 of the bore 20 to bias the cap 44 into the position shown in FIGS. 2-4, wherein the ridges 50 engage the wall or segment 32. A second spring 60 is disposed within the first section 22 and the fourth section 28 of the bore 20. The second spring 60 biases the valve stem 34 into the position shown in FIG. 3. in the absence of a gaseous fluid exerting a force on the face 38 of the valve stem. A tamper seal member 62 is disposed exteriorly of the valve housing 18 near the first axial end 36 of the valve stem 34. The tamper seal member 62 has two leg sections 70, 72, pan of which is disposed within the fifth section or recess 30 of the bore 20 (about the valve stem 34). The first axial end 36 of the valve stem 34 extends beyond the valve housing 18 and beyond the tamper seal member 62. The valve stem 34 includes a stepped reduced diameter section 74 adjacent to its first axial end 36. A head member 64 is connected to the first axial end 36 of the valve stem 34. The head member 64 abuts with the section of the legs 70, 72 of the tamper seal member 62 within the fifth section 30 of the bore 20 when the valve stem is depressed to the position shown in FIG. 3. The tamper seal member 62, thus, limits the downward movement of the valve stem into the container 12.

The legs 70, 72 each have a rib 76 projecting outwardly on their inside surface which fit snugly about the reduced diameter section 74 of the valve stem 34. Accordingly, if the head member 64 is removed from the valve stem 34, the upper stepped shoulder 78 on the valve stem 34 will abut with ribs 76 on each leg 70, 72 when the valve stem is depressed to the position shown in FIG. 3 to prevent opening of the valve even if the head member 64 is removed.

First leg 70 terminates with a breakaway piece 80 that separates from tamper seal member 62 when it is removed from the valve housing 18 (See FIG. 7). Second leg 72 is illustrated as terminating with a pilot pin 82 to guide the relative movement between tamper seal 62 and valve housing 18. The valve housing 18 has a front block 84 having two through holes 86, 88 to receive the breakaway piece 80 and the pilot pin 82, respectively. The valve housing also has a rear tab 90 to guide the relative movement between tamper seal 62 and valve housing 18. Rear tab 90 includes a radially projecting overhang 92 to prevent the lifting of tamper seal member 62 when it is connected to the valve housing 18. The forward end of leg 70 is bifurcated and the inner surface of piece 80 is tapered outwardly and rearwardly, thus, when the leg 70 enters the hole 86, the piece 80 will deflect inwardly until it clears the hole whereupon it will snap back to its normal position shown in FIG. 7 wherein it engages recessed shelf 81. When the seal member 62 is pulled rearwardly, as by grasping handles 83, the piece 80 will snap off.

The operation of the pindicator valve will be described below with reference to FIGS. 2-6. The pindicator valve assembly 10 is threadably connected to the container 12, as shown in FIG. 2. The valve stem 34 is axially moveable between a first position shown in FIG. 2, a second position shown in FIGS. 3 and 4, and a third position shown in FIG. 6. Additionally, cap 44 is axially moveable between the first position shown in FIGS. 2-4, and a second position shown in FIG. 6, wherein the cap is in spaced relationship to the wall or segment 32. FIG. 2 may be referred to as the home or rest position of the pindicator valve assembly because this is the default position that the valve assembly will assume when no outside forces are applied to it and there is sufficient gas pressure within the container. Typically, the container 12 will contain a dry chemical powder and a pressurized gas which is used to expel the powder. The powder and the pressurized gas are free to communicate with chamber 56. However, the raised ridges 50 on the cap 44 prevent the powder from communicating with chamber 54 because the size of the gap 52 is smaller than the size of the powder. However, pressurized gas is permitted to communicate with chamber 54. If the container 12 is pressurized sufficiently, the pressurized gas will exert a force on the face of the second axial end 38 of the valve stem 34 that overcomes the pressure applied on the valve stem 34 from the second spring 60. The valve stem 34 will, thus, rise or move upwardly to the home position shown in FIG. 2. A bevelled section 66 of the valve stem 34 abuts with the step transition between the first section 22 and the fourth section 28 of the bore to limit the upward movement of the valve stem 34.

To test whether the pressurized gas within the container 12 has sufficient pressure, the user depresses the head member 64 on the first axial end 36 of the valve stem 34 to the position shown in FIGS. 3 and 4. As discussed above, the legs 70, 72 of tamper seal member 62 prevent the movement of the valve stem 34 to a position below that shown in FIGS. 3 and 4. Additionally, if the head member 64 is removed, the ribs 76 prevent the movement of valve stem 34 to a position below that shown in FIGS. 3 and 4. Accordingly, during the pressure testing, the user cannot separate the cap 44 from its seat on the transition segment 32 and accidentally dispense the contents of the container 12.

The user then releases the head member 64. The second axial end 38 of the valve stem 34 will now be in the position shown in FIG. 4. Because the pressurized gas is permitted to communicate with chamber 54, the valve stem 34 will move upwardly to the position shown in FIG. 2 if the pressure is greater than a predetermined pressure. The user can, thus, be assured that the container 12 is sufficiently charged.

In this manner, numerous pressure tests can be performed to ensure that the container 12 is sufficiently charged. The use of the dust cap 44 prevents the dry chemical powder frequently contained within fire extinguishers from entering chamber 54 and, thus, fouling the axial movement of the valve stem 34. If the powder were allowed to enter the chamber 54, it is quite possible that the powder would build up or cake on the walls of the first section of the bore 22 and around the O-rings 40 to a point where the axial movement of the valve stem 34 could be prevented. This could result in a false negative pressure test, if the valve stem 34 were to be stuck, due to the caking of the powder, in the position shown in FIG. 3. Worse yet, the caking of the powder could cause a false positive test, if the caking of the powder prevents the movement of the valve stem from the position shown in FIG. 2. The user might incorrectly conclude that there was sufficient pressure within the container even though the valve stem was never actually depressed.

To expel powder from the container, the tamper seal member 62 must first be removed from the valve housing 18. The head member 64 is then depressed to the position shown in FIG. 6. In this position, the second axial end 38 of the valve stem 34 abuts the disc-shaped section 48 of cap 44 and lifts the cap 44 off of the transition segment 32 to open the valve 10. It will be appreciated that in this open position, the powder and the compressed gas are allowed to pass by the cap 44 and out through nozzle 68.

From the foregoing description, it will be appreciated that the present invention makes available, a compact, cost efficient, pindicator-type valve arrangement. The pindicator valve is designed to allow for simple operation while allowing accurate testing of the pressure contained with the container.

Having described the presently preferred exemplary embodiment of a new and improved pindicator valve arrangement in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What I claim is:

1. A valve comprising:

a housing having a through bore, said bore having a first section and a second section of different diameters and a transition segment therebetween;

a valve stem having a first axial end and a second axial end, said valve stem being at least partially disposed within said bore and being axially movable between a first position, a second position and a third position, said valve stem including sealing means adjacent to said second axial end for sealing with said first section of said bore; and a cap being disposed within said second section of said bore, said cap being axially movable between a first position and a second position, and sealing means between said cap and said bore for sealing said cap with said bore when said cap is in said first position, said cap sealing means being impermeable to solids and permeable to gas when said cap is in said first position.

2. The valve according to claim 1, wherein said cap includes an annular ring shaped section and has a plurality of outwardly projecting raised ridges from said ring shaped section which contact said transition segment to prevent the flow of a dry chemical powder and allow the flow of a pressurized gas passed said cap and said transition segment when said cap is in said first position.

3. The valve according to claim 2, further including a first spring being disposed within said second section of said bore, said first spring biasing said cap into said first position.

4. The valve according to claim 3, further including a second spring being disposed within said first section of said bore, said second spring biasing said valve stem into said second position.

5. The valve according to claim 4, further including a tamper seal member being disposed exteriorly about said housing adjacent to a first axial end of said valve stem, said first axial end of said valve stem extending outside of said housing and beyond said tamper seal member.

6. The valve according to claim 5, wherein said tamper seal member includes a first leg and a second leg.

7. The valve according to claim 6, wherein said first leg and said second leg each including an outwardly projecting rib.

8. The valve according to claim 5, further including a head member connected to said first axial end of said valve stem.

9. The valve according to claim 8, wherein said head member abuts said tamper seal member in said second position to prevent said valve stem from moving to said third position.

10. The valve according to claim 9, wherein said valve stem is movable from said second position to said third position only when said tamper seal member is removed from said housing, said cap being moveable from said first position to said second position in association with the movement of said valve stem from said second position to said third position, when said cap is in said second position and said valve stem is in said third position said pressurized gas and said dry chemical powder are permitted to flow passed said cap and said sealing means of said valve stem.

11. The valve according to claim 10, wherein said bore includes a third section of different diameter than said first and second sections, said first section being disposed between said third and second sections, said valve stem including a second sealing means adjacent to said first axial end for sealing with said third section of said bore.

12. A container comprising:

a container housing having an outlet;

a valve housing being disposed in said outlet, said valve housing having a through bore, said bore having a first section and a second section of different diameters and a transition segment therebetween;

a valve stem having a first axial end and a second axial end, said valve stem at least partially being disposed within said bore and being axially movable between a first position, a second position and a third position, said valve stem including sealing means adjacent to said second axial end for sealing with said first section of said bore; and a cap being disposed within said second section of said bore, said cap being axially movable between a first position and a second position, sealing means between said cap and said bore for sealing said cap with said bore when said cap is in said first position, said cap sealing means being impermeable to solids and permeable to gas when said cap is in said first position.

13. The valve according to claim 12, wherein said cap includes an annular ring shaped section and has a plurality of outwardly projected raised ridges from said ring shaped section which contact said transition segment to prevent the flow of a dry chemical powder and allow the flow of a pressurized gas passed said cap and said transition segment when said cap is in said first position.

14. The valve according to claim 13, further including a first spring being disposed within said second section of said bore, said first spring biasing said cap into said first position.

15. The valve according to claim 14, further including a second spring being disposed within said first section of said bore, said second spring biasing said valve stem into said second position.

16. The valve according to claim 15, further including a tamper seal member being disposed exteriorly about said housing adjacent to a first axial end of said valve stem, said first axial end of said valve stem extending outside of said housing and beyond said tamper seal member.

17. The valve according to claim 16, wherein said tamper seal member includes a first leg and a second leg.

18. The valve according to claim 17, wherein said first leg and said second leg each including an outwardly projecting rib.

19. The valve according to claim 16, further including a head member connected to said first axial end of said valve stem.

20. The valve according to claim 19, wherein said head member abuts said tamper seal member in said second position to prevent said valve stem from moving to said third position.

21. The valve according to claim 20, wherein said valve stem is movable from said second position to said third position only when said tamper seal member is removed from said housing, said cap being moveable from said first position to said second position in association with the movement of said valve stem from said second position to said third position, when said cap is in said second position and said valve stem is in said third position said pressurized gas and said dry chemical powder are permitted to flow passed said cap and said sealing means of said valve stem.

22. The valve according to claim 21, wherein said bore includes a third section of different diameter than said first and second sections, said first section being disposed between said third and second sections, said valve stem including a second sealing means adjacent to said first axial end for sealing with said third section of said bore.

* * * * *